US006256470B1

(12) United States Patent
Taniyama et al.

(10) Patent No.: US 6,256,470 B1
(45) Date of Patent: Jul. 3, 2001

(54) TONER SUPPLY DEVICE FOR USE IN IMAGE FORMING SYSTEM AND TONER CARTRIDGE FOR USE THEREIN

(75) Inventors: Yoshiharu Taniyama, Kawasaki; Shinichi Ito, Yokohama, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/523,098

(22) Filed: Mar. 10, 2000

Related U.S. Application Data

(63) Continuation-in-part of application No. 09/506,927, filed on Feb. 18, 2000.

(51) Int. Cl.[7] ..... G03G 15/08

(52) U.S. Cl. ..... 399/262; 399/120; 222/DIG. 1

(58) Field of Search ..... 399/262, 263, 399/120; 222/DIG. 1

(56) References Cited

U.S. PATENT DOCUMENTS 5,774,773 * 6/1998 Otsuka et al. ..... 399/262
5,812,915 * 9/1998 Farkash ..... 399/262
5,890,040 * 3/1999 Matsuoka et al. ..... 399/262
5,907,756 * 5/1999 Shirota et al. ..... 399/262
5,966,574 * 10/1999 Ui et al. ..... 399/258
5,970,290 * 10/1999 Yoshiki et al. ..... 399/261
5,970,291 * 10/1999 Miller ..... 399/262
5,983,059 * 11/1999 Oka et al. ..... 399/262
5,991,584 * 11/1999 Meyer et al. ..... 399/262
6,064,846 * 5/2000 Wang et al. ..... 399/262
6,067,423 * 5/2000 Huang ..... 399/262
6,134,411 * 10/2000 Meyer et al. ..... 399/262
6,137,972 * 10/2000 Playfair et al. ..... 399/106

* cited by examiner

*Primary Examiner*—Richard Moses
(74) *Attorney, Agent, or Firm*—Foley & Lardner

(57) ABSTRACT

A toner supply device includes a toner cartridge comprising a cylindrical container having a spiral protruding portion therein, and a cap having a toner discharging hole; and a drive unit for supplying a toner from the toner discharging hole while gripping and rotating the cap of the toner cartridge. A positioning portion is formed on the outer peripheral surface of the base end side of the cylindrical container, and a recessed portion engaging the positioning portion is formed in an inlet holder. The drive unit includes a holder and a holder cover, which are disassembled vertically; a cup-shaped holder guide, rotatably provided in the holder and holder cover, for gripping the cap at a position, at which the holder guide is communicated with the toner discharging hole; a motor for applying torque to the holder guide; and a drive gear for transmitting torque of the motor to the holder guide. A gripping handle is provided on the bottom of the cylindrical container of the toner cartridge.

29 Claims, 16 Drawing Sheets

TONER SUPPLY DEVICE FOR USE IN IMAGE FORMING SYSTEM AND TONER CARTRIDGE FOR USE THEREIN

This application is a continuation-in-part of Ser. No. 09/506,927, filed Feb. 18, 2000.

BACKGROUND OF THE INVENTION

The present invention relates generally to a toner supply device for use in an image forming system, such as a copying machine, a facsimile or a printer. More specifically, the invention relates to a toner supply device for supplying a toner while rotating an exchangeable cylindrical toner cartridge and for breaking local accumulation of the toner in the toner cartridge by rotating the toner cartridge in forward and reverse directions by a predetermined angle during exchange of the cartridge or in a desired situation.

In a typical image forming system, the surface of an electrified photosensitive material drum is electrified, and an image information to be copied is exposed to the surface of the drum to form a latent image. Then, a toner is absorbed into the photosensitive material to form a visible image. This visible image is transferred to the surface of a paper, and the toner is fixed on the surface of the paper by heat and pressure. Then, cleaning and de-electrification are carried out to cause a predetermined image information to be a printed information on the surface of the paper. In a developing process for forming the visible image, the toner, together with a carrier of a magnetic material, is used as a developer.

The carrier serving as a main component included in the developer is used for carrying the toner and producing frictional electrification. Since this carrier is electrified to be used for causing the toner to be absorbed into the photosensitive material drum and the surface of the paper, the carrier does not adhere to the surface of the paper and is not consumed, so that the amount of the carrier does not decrease. On the other hand, although the toner itself is not electrified, the toner is gradually consumed to be decreased when a printed matter is prepared after processes, such as transfer, fixing and cleaning. Therefore, the toner must be supplied as required with the use of the image forming system.

The way for supplying the toner is broadly divided into two methods. One of the methods is a method for providing a cartridge dedicated to the copying machine and for supplying a predetermined amount of toner, which is filled in a container, from a supply port of the cartridge when the residual quantity of the toner in the copying machine is short. According to this method, when the toner is supplied to the cartridge from a container, it is difficult for a usual user to skillfully fill the toner in the small-diameter supply port of the cartridge, if not for experts, so that there is the possibility that the toner spills to dirty user's cloths and/or hands. If the spilled toner is raked up to be put in the cartridge, there is also the possibility that impurities are mixed therein.

The other toner supply method is a method using an exchangeable cartridge. This method is an excellent supply method easy to be used, since the exchangeable cartridge is capable of supplying a toner, which is mixed at the best to cause the image forming system to display the best performance to prepare a copied matter, to the developing part of the image forming system without mixing impurities, and of preventing the user for supplying the toner from spilling the toner or the user's cloths and/or hands from being dirtied.

In order to supply a toner using a conventional toner supply device, an empty cartridge formed so as to have a predetermined shape and standard is detached from a cartridge attaching part of a copying machine, and an exchanged cartridge which has the same shape and standard as those of the empty cartridge and which is filled with a toner, is attached on the cartridge attaching part after being sufficiently shaken. Although there are various shapes and capacities of toner cartridges, there is a cylindrical toner cartridge as one of them. The cylindrical toner cartridge has the merit of being capable of utilizing the inner peripheral wall to efficiently supply a toner to a discharging hole. If the cylindrical cartridge is horizontally arranged, a spiral groove is formed in the inner wall surface of the cylindrical cartridge, or the cylindrical cartridge is rotated about the central axis thereof, so that the toner is guided toward the discharging hole.

However, according to such a conventional toner supply device, there is a problem in that it is difficult to carry out the operation of inserting a toner receiving container of the toner cartridge into a narrow space of an image forming system, such as a copying machine, in a horizontal direction. In particular, there is a problem in that the operation of holding and inserting a very heavy container, which is filled with the toner, by user's fingers is very difficult, although the operation of detaching an empty container, in which a toner is completely consumed, is not so difficult. Therefore, it is important to form a holding part, which can cause the user to surely hold a toner cartridge, on the bottom side of the toner receiving container.

In addition, in a toner cartridge of a type wherein the tip portion of a toner receiving container is formed as a stepped small-diameter cylindrical portion and wherein a toner discharging hole is formed in the periphery of the small-diameter cylindrical portion, the toner discharging hole formed in the periphery is preferably held so as to face upwards. The toner discharging hole is often provided with a shielding cover for shielding the toner discharging hole when the toner cartridge is not attached and for opening the toner discharging hole only when it is required to supply the toner. Even if the shielding cover is provided, the problems in the leakage of the toner and so forth are not serious if the toner discharging hold faces upwards.

In particular, although there is often an opportunity to open the shielding cover during exchange of the toner cartridge, it is important to hold the toner cartridge while turning the toner cartridge upwards until it is required to actually supply the toner to a developing device. However, during exchange of the toner cartridge, there is a problem in that the direction of the toner discharging hole provided in the tip side can not be confirmed from the bottom side. Therefore, it is requested that the direction of the toner discharging hold provided in the tip cylindrical portion of toner cartridge, which begins to be inserted inside of a body, such as a copying machine, can be confirmed from the bottom side.

SUMMARY OF THE INVENTION

It is therefore an object of the present invention to eliminate the aforementioned problems and to provide a toner supply device capable of easily holding the bottom side of a toner receiving container during exchange of a toner cartridge to easily attach and detach the toner cartridge, and of confirming the direction of a toner discharging hole during exchange of the toner cartridge from the bottom side of the toner cartridge.

In order to accomplish the aforementioned and other objects, according to a first aspect of the present invention, there is provided a toner cartridge for use in a toner supply device for supplying a toner to an image forming system for forming an optional image including characters and pictures with the toner, the toner cartridge comprising: a toner container having a cylindrical shape having an opening at a tip end thereof, the toner container carrying a toner, which is housed therein, toward the opening along a spiral protruding portion formed in an inner peripheral surface thereof when being rotated about an axis thereof, the toner container having a handle on an external surface of a base end portion thereof; a substantially cup-shaped cap engaging the opening and having a toner discharging hole for discharging the toner carried in the toner container, the toner discharging hole always faces in a predetermined direction if the toner container is turn in a certain rotational direction with respect to an axis of the toner container by fixing the cap in a predetermined positional relationship when the toner container is attached; and a cylindrical cover engaging the cap so as to reciprocate in axial directions with respect to the cap, the cylindrical cover being capable of engaging the cap at a first position, at which the toner discharging hole is closed to prevent the toner from being discharged, and at a second position, at which the toner discharging hole is open to allow the toner to be discharged.

According to a second aspect of the present invention, a toner supply device comprises: a toner cartridge including a spiral protruding portion spirally protruding from at least an inner peripheral surface thereof, a filling positioning portion provided in a peripheral surface thereof in the vicinity of a base end portion of closed both end portions, and a toner discharging hole formed in the periphery thereof in the vicinity of a tip end portion of the both end portions, the toner cartridge having a handle for holding the toner cartridge on a bottom thereof, the toner cartridge having a cylindrical container, on which a mark for indicating the direction of the toner discharging hole is formed at a position, at which the mark is capable of being visually observed from a bottom side; a cartridge supporting portion, provided on a body, for horizontally supporting thereon the toner cartridge while allowing rotation of the toner cartridge; an inlet holder provided on one end of an inlet side of the cartridge supporting portion, the inlet holder including a body-side positioning portion, which engages the filling positioning portion so that the toner discharging hole always faces upwards when the toner cartridge is attached and detached, and a biasing member for continuing to bias the base end portion of the toner cartridge toward the tip end portion by a predetermined biasing force after the toner cartridge is attached; and a drive unit including a cup-shaped gripping portion for covering a peripheral surface of the one end including the toner discharging hole of the toner cartridge and for gripping the toner cartridge while a position of a toner supply hole corresponding to the toner discharging hole of the toner cartridge is coincident with the toner discharging hole so as to always face upwards when the toner cartridge is attached, a drive gear comprising a gear set including a gear provided on a bottom of the gripping portion and a gear meshing therewith, and rotation driving means for applying a torque to the gripping portion and the toner cartridge gripped by the gripping portion via the drive gear.

In the toner cartridge according to the first and second aspects, the handle formed on a bottom of the toner cartridge may be supported on two legs having a substantially C-shaped cross section, the handle being associated with a recessed portion formed in the bottom to form a sufficient gripping margin.

In the toner cartridge according to the first and second aspects, a mark for indicating the position of the toner discharging hole may be provided on the surface of the handle.

In the toner cartridge according to the first and second aspects, the handle may have a non-slip portion.

In the toner cartridge according to the first and second aspects, the handle formed on a bottom of the toner cartridge may be supported on one leg having a substantially T-shaped cross section, the handle being associated with a recessed portion formed in the bottom to form a sufficient gripping margin.

In the toner cartridge according to the first and second aspects, a mark for indicating the position of the toner discharging hole may be provided on the surface of the handle.

In the toner cartridge according to the first and second aspects, the handle may have a non-slip portion.

DESCRIPTION OF THE PREFERRED EMBODIMENT

Referring now to the accompanying drawings, the preferred embodiments of a toner supply device for use in an image forming system, according to the present invention, will be described in detail below. In the preferred embodiments described below, a copying machine is used as an example of an image forming system, and while the detailed structure thereof will be described, a toner supply device for use in the copying machine will be described as an example.

Figure 1:
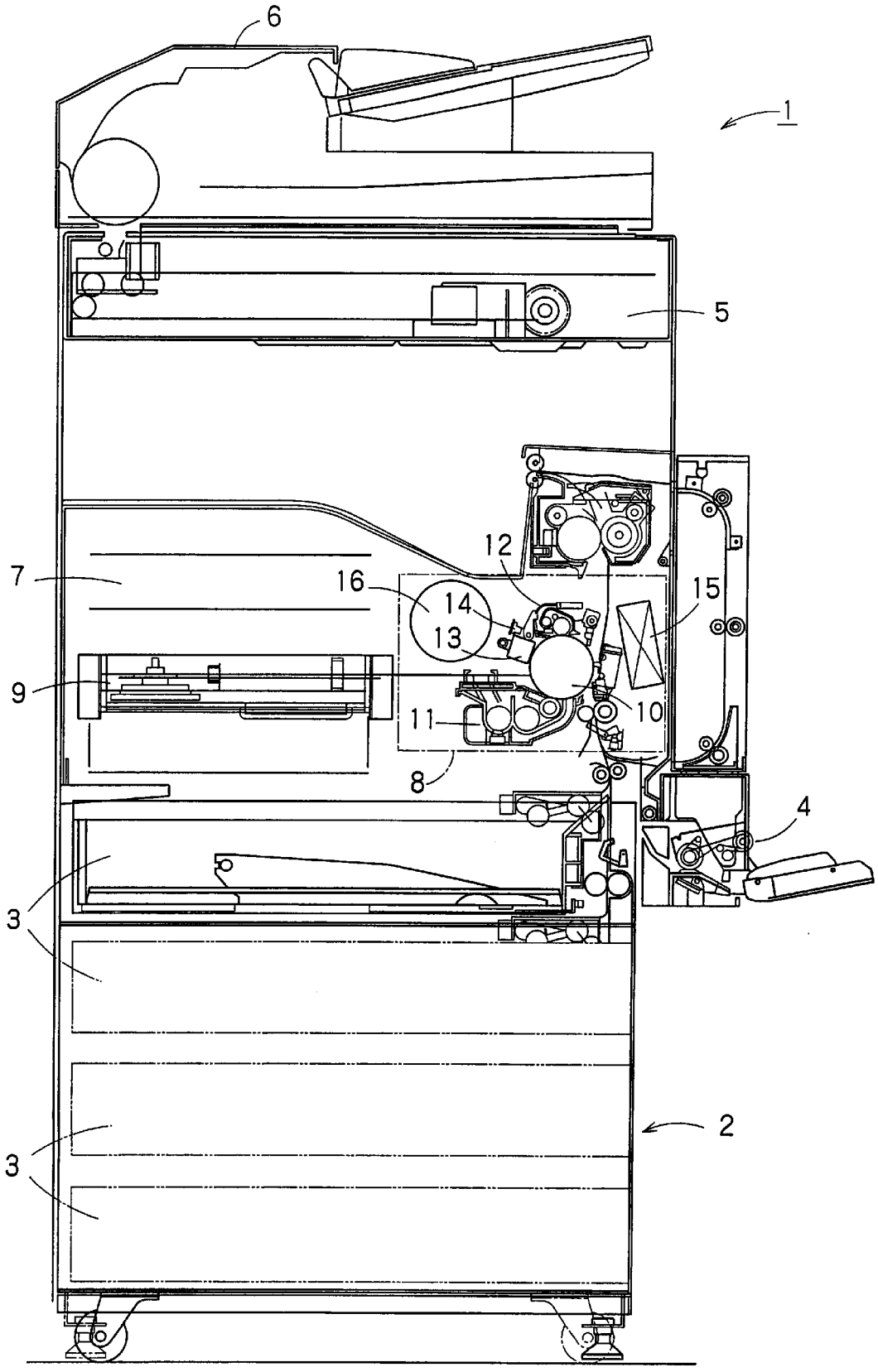
FIG. 1 is a sectional view showing the whole construction of a copying machine as an image forming system, to which a toner supply device according to the present invention is applied.

FIG. 1 is a sectional view showing the whole construction of a copying machine, in which a toner supply device according to the present invention is provided. In FIG. 1, a copying machine 1 has a paper feeding cassette device 2 for housing therein a large number of papers, in the lower portion of the body thereof. The copying machine 1 also has an LCF paper feeding device 3 for feeding a large number of papers having the same size, and a manual paper feeding device 4 capable of manually feeding various kinds of papers having various sizes.

The copying machine 1 comprises: an image reading part 5, provided in the upper portion, for reading a manuscript; an automatic manuscript feeding device 6 for feeding the manuscript to the image reading part 5; an image storing part 7 for storing image data read by the image reading part 5; and an optical laser system 9 for deriving the stored image data to write an image to be printed, in an image forming part 8.

Figure 2:
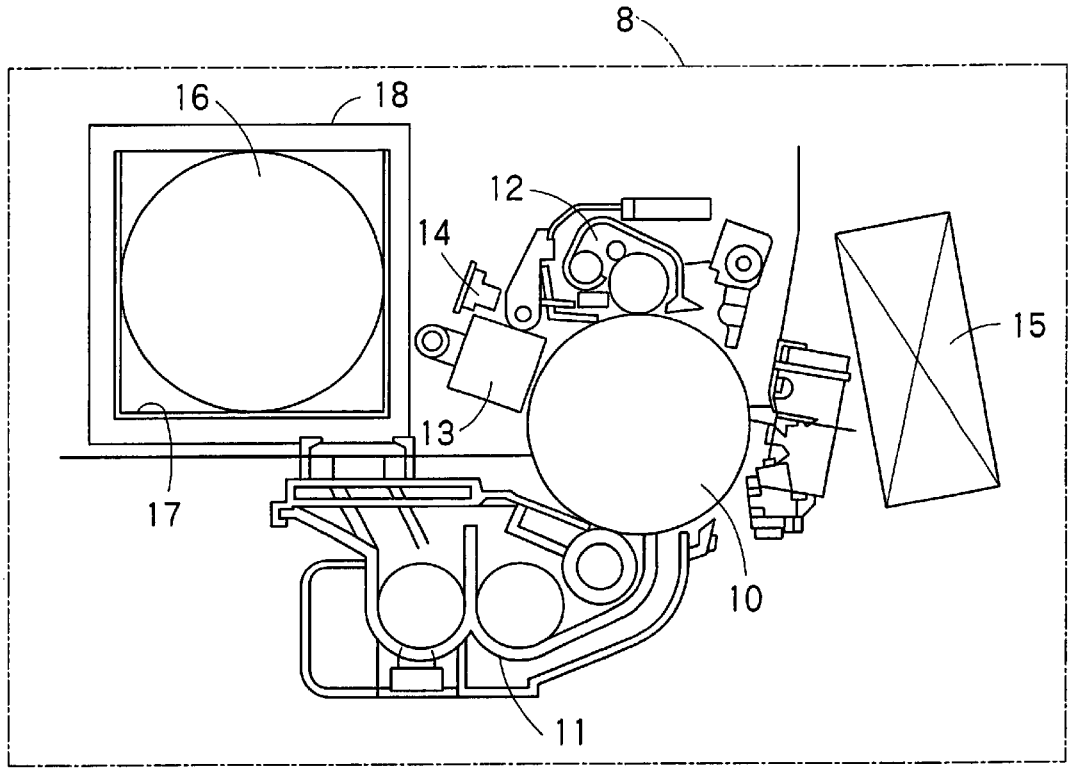
FIG. 2 is a schematic diagram showing a principal part of a toner supply device.

As shown in FIG. 2 in addition to FIG. 1, the image forming part 8 comprises a photosensitive material drum 10, a developing device 11, a cleaner 12, an electrification charger 13, a de-electrifying lamp 14, and a transfer/peeling charger 15. On the developing device 11, a toner cartridge 16 for supplying a toner, and a driving part 17 (not shown in FIGS. 1 and 2) for rotating the toner cartridge 16 are attached.

Figure 3:
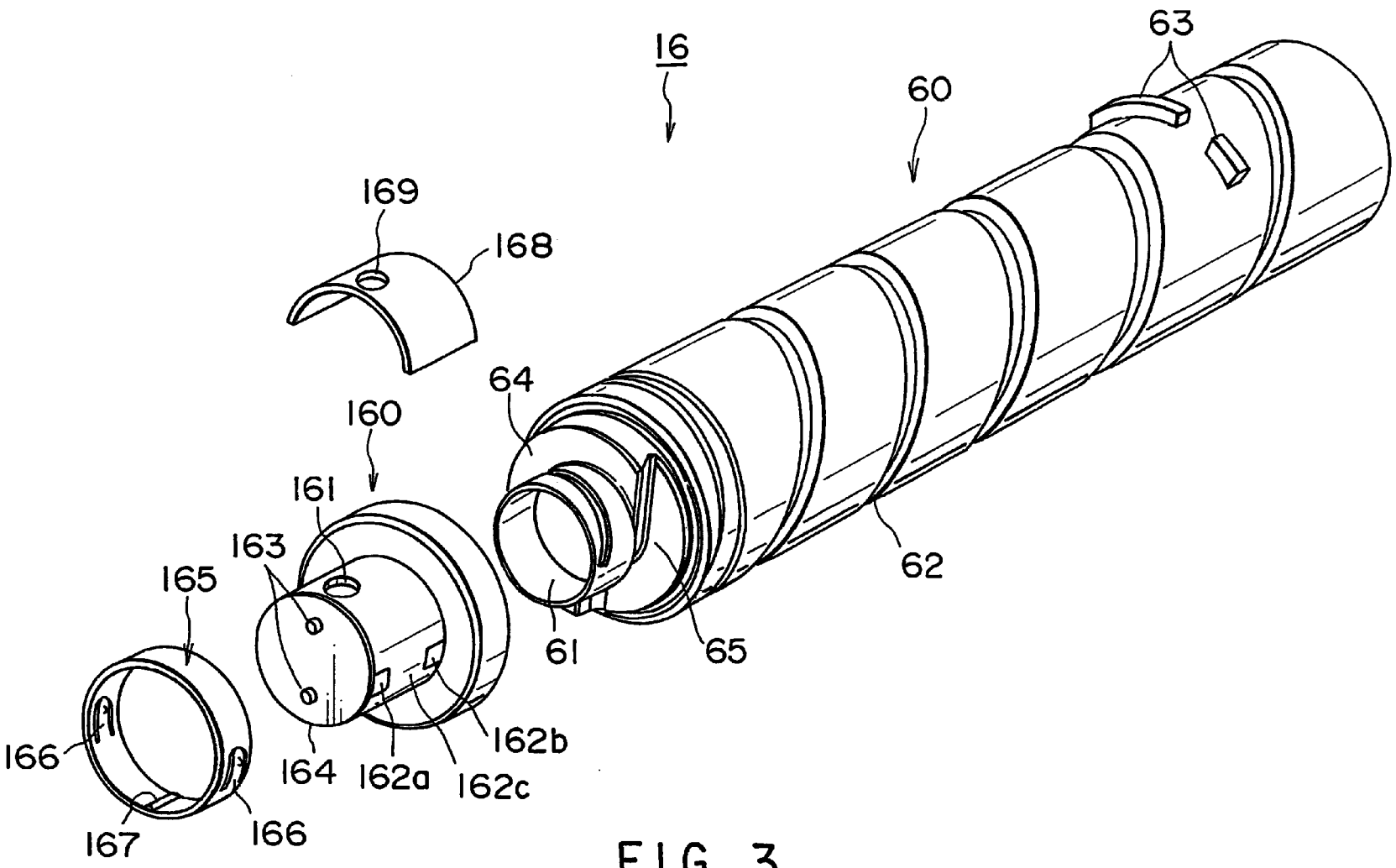
FIG. 3 is an exploded perspective view showing the details of a cylindrical container and cap constituting a toner cartridge.

Referring to FIG. 3, the detailed construction of the toner cartridge 16 will be described. In FIG. 3, the toner cartridge 16 comprises a cylindrical container 60 serving as a body, a cap 160 serving as a toner discharging part, and a discharging hole shielding cover 165.

The cylindrical container 60 has a cylindrical shape with a bottom. At least on the inner peripheral surface of the cylindrical container 60, there is formed a spiral protrusion (not shown) for gradually feeding a toner, which is previously filled, toward an opening portion 61 as the cylindrical container 60 rotates. In the first preferred embodiment shown in FIG. 3, the cylindrical container 60 is formed of a synthetic resin by the blow molding, so that a spiral groove 62 is formed in the outer peripheral surface of the cylindrical container 60 so as to correspond to the spiral protrusion for guide.

At a predetermined position spaced from the bottom of the cylindrical container 60, there are provided positioning portions 63 for positioning the outer periphery of the cylindrical container 60. In the first preferred embodiment shown in FIG. 3, two positioning portions 63 are formed by removing a part of a peripheral flange.

The opening portion 61 of the cartridge 16 is formed at the center of a stepped portion 64 and projects therefrom so as to have a predetermined diameter. A part of the stepped portion 64 is formed with a positioning cut-out portion 65 for integrating the container 60 with the cap 160 so as to establish a predetermined relationship between the positions of a discharging hole 161, which will be describe later, and the positioning portions 63 when the cap 160 is mounted on the cylindrical container 60.

The cap 160 has a shape having a stepped portion, which corresponds to the shape of the periphery of the opening portion 61 of the cylindrical container 60, as a whole. The cap 160 has the discharging hole 161 at an optional position on the peripheral wall thereof. The cap 160 is provided for supplying one dose of the toner when the cap 160 is rotated by a half rotation from the initial position to face downwards during the rotation of the toner cartridge 16 after the cap 160 is mounted on the cylindrical container 60. At positions shifted from the discharging hole 161 by 90 degrees in the peripheral wall surface, two engaging portions (protrusions) 162*a* and 162*b* for engaging a discharging hole shielding cover 165, which will be described later, are provided on each of both sides. Although only the engaging portions 162*a* and 162*b* on one side are shown in FIG. 3, other two engaging portions 162*a* and 162*b* are provided at positions shifted from the engaging portions 162*a* and 162*b* on the shown side by 180 degrees. As will be described in detail later, a groove 162*c* is formed between the two engaging portions 162*a* and 162*b*, and the cover 165 is designed to move in the groove 162*c* in axial directions to contact the engaging portions 162*a* and 162*b*.

On the tip flat surface of the cap 160, there are provided protruding portions 163 serving as positioning portions for engaging positioning recessed portions (not shown) formed in a flat surface of the inner wall of a holder guide of a drive unit 20, which will be described later, to inhibit the rotational shift between the holder guide and the toner cartridge 16. In this first preferred embodiment, the protruding portions 163 are formed by two bosses arranged in the radial directions corresponding to the position of the discharging hole 161. In addition, the protruding portions 163 serve to rotate the cylindrical container 60 while receiving the torque of a motor 26 (FIG. 4) which will be described later. On the opposite side of the discharging hole 161 in the radial direction in the peripheral wall of the cap 160, a guide groove 164 for guiding the axial movement of the cover 165 is formed so as to extend in axial directions.

The cover 165 for shielding and opening the discharging hole 161 has a ring shape having a predetermined diameter and a predetermined width which is greater than the diameter of the discharging hole 161. The cover 165 facing the engaging portions 162*a* and 162*b* and grooves 162*c* has protrusions for engaging the engaging portions 162*a* and 162*b*, and elastic spring portions 166 formed by forming U-shaped cut-outs in the periphery thereof. That is, the U-shaped cut-outs are formed in the cover 165 in circumferential directions thereof to form elastic tongue pieces 166 serving as cantilevers, and inner stoppers 166*a* are formed on the internal and external surfaces of the tongue pieces 166 so as to be movable in the grooves 162 of the cap 160 in axial directions to abut on the protrusions 162*a* and 162*b*.

Moreover, as described above, a protruding portion 167 protruding from the inner peripheral surface of the cover 165 to extend in axial directions thereof is provided so as to correspond to the guide groove 164 of the cap 160. The protruding portion 167 is positioned by the guide groove 164 so that the cover 165 is slidable along the peripheral surface of the cap 160.

Although the discharging hole 161 is open and closed by the sliding of the cover 165, there is a slight gap between the outer peripheral surface of the cap 160 and the inner peripheral surface of the cover 165. In order to prevent the toner from leaking from the gap while shielding the discharging hole 161, a seal 168 of an elastic material, such as felt or sponge, is applied on a portion surrounding the discharging hole 161. The seal 168 has a through hole 169 formed so as to face the discharging hole 161. The construction of the toner cartridge has been described above.

Figure 4:
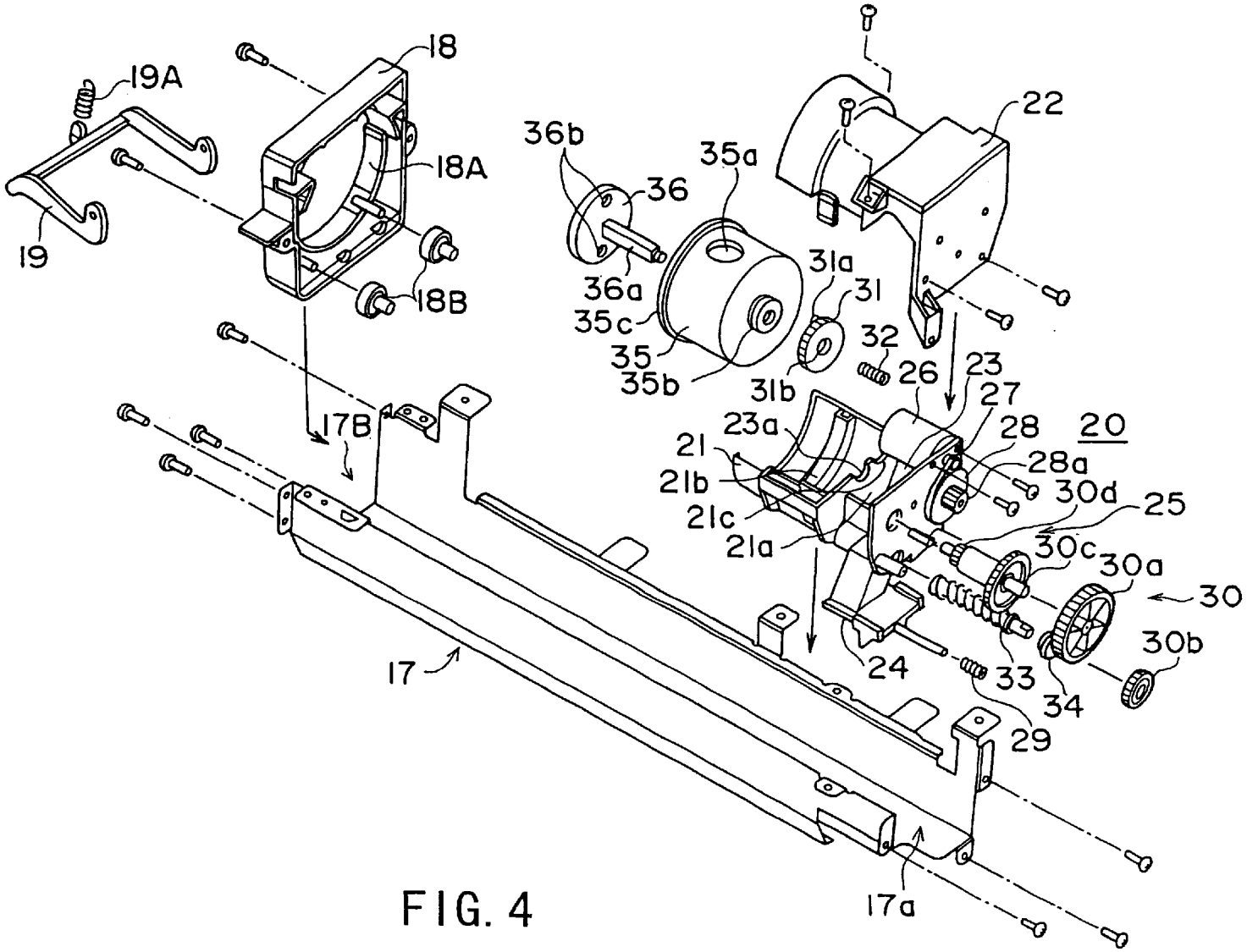
FIG. 4 is an exploded perspective view showing a driving unit of a toner supply device.

Referring to FIG. 4, the construction of the drive unit 20 for rotating the above described toner cartridge 16 will be described below.

Briefly, the torque of the motor 26 is transmitted to a disk (driving plate) 36 to rotate the toner cartridge 16 since the protruding portions 163 of the toner cartridge 16 are inserted into recessed grooves (driving holes) 36*b*, 36*b* formed in the disk 36. In addition, a carrier auger 33 is rotated by the motor 26 to move the toner from a chamber 23 to a hopper 24. The detailed construction of the drive unit 20 will be described below.

In FIG. 4, a cartridge receiving portion 17 is secured to the body of the copying machine 1, and is a substantially U-shaped receiving member of a metal or synthetic resin. The drive unit 20 is mounted on an end portion 17*a* of the U-shaped receiving portion 17 on the front side in the figure. A rectangular inlet guide 18 is secured to the other end portion 17*b* of the receiving portion 17 by means of a screw or the like. The inlet guide 18 has a guide hole 18A having a diameter capable of receiving the toner cartridge 16, and two rollers 18B along the periphery of the insertion opening 18A for rotatably supporting the toner cartridge 16.

Figure 5:
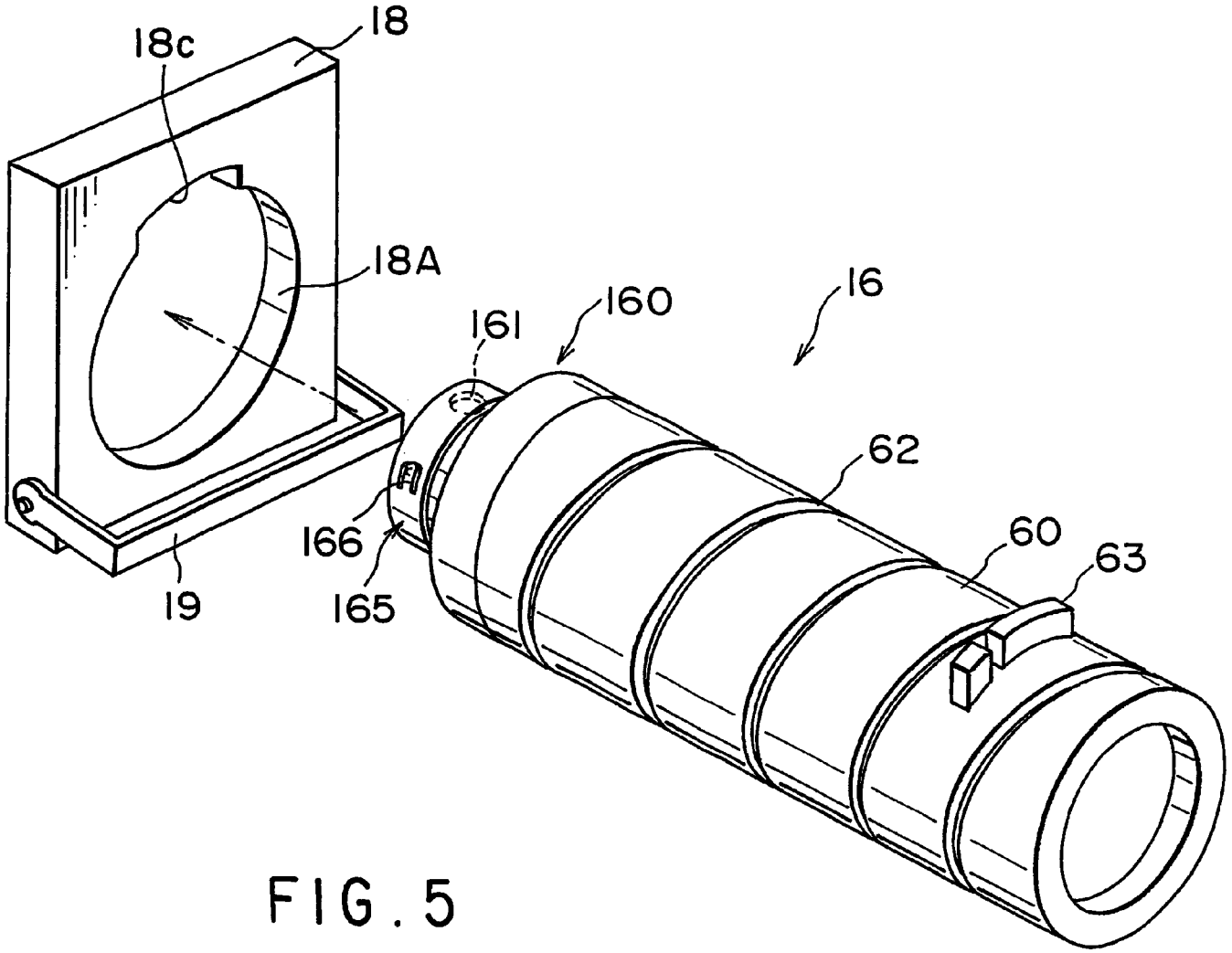
FIG. 5 is a perspective view showing a toner cartridge while being inserted into an inlet holder.

On the inlet guide 18, there is mounted a substantially C-shaped biasing lever 18 for biasing the bottom of the cylindrical container 60 toward the drive unit 20 after the toner cartridge 16 is attached. The biasing lever 19 biases the cylindrical container 60, which is inserted by a spring 19A in a horizontal direction, toward the drive unit 20 from the guide 18. FIG. 5 is a perspective view schematically showing the inlet holder 18, the biasing lever 19 and the toner cartridge 16 when the toner cartridge 16 is inserted into the inlet holder 18. As shown in this figure, on the upper side of the inner peripheral surface of the insertion opening 18A, there is formed a recessed portion 18C engaging the protruding positioning portion 63 of the cylindrical container 60, i.e., allowing the insertion and extraction of the toner cartridge 16.

As shown in FIG. 4, the drive unit 20 comprises: a substantially semicylindrical holder 21; a holder cover 22 integrated with the holder 21 for forming a cylinder which is open toward the inlet guide 18; a chamber 23 defined by the holder 21 and the holder cover 22; a hopper 24 for supplying a toner, which is filled in the chamber 23, to the developing device 11; and a drive mechanism 25 arranged in the vicinity of the chamber 23. The holder 21 and the holder cover 22 have a shape formed by dividing a cylinder. The holder 21 has a partition wall 21*a* defining the chamber 23, and an engaging partition wall 21*b* engaging a flange portion 35*c* of a holder guide 35 which will be described later. The partition wall 21*a* has a cut-out 21*c* which is associated with a facing partition wall (not shown) of the holder cover 22 for forming a hole.

The drive mechanism 25 comprises a motor 26 serving as a driving source, a belt 27, a pulley 28, drive gear sets 30, 31, a spring 32, a carrier auger 33 for promoting the movement of the toner from the chamber 23 to the hopper 24, a bush 34, a holder guide 35 and a disk 36. Furthermore, reference number 29 denotes a spring mounted on a pin of a cover of the hopper 24. The drive gear set 30 comprises: a large-diameter first gear 30*a*; a second gear 30*b* which meshes with the first gear 30*a* and which is mounted on the carrier auger 33 via the bush 34; a third gear 30*c* which meshes with a gear 28*a* integrated with the pulley 28 outside of the chamber 23; and a fourth gear 30*d* mounted on one end of a shaft, on the other end of which the third gear 30*c* is mounted. The fourth gear 30*d* is arranged in the chamber 23, and is designed to mesh with the gear set 31 fixed to the holder guide 35.

The holder guide 35 is a cup-shaped member having a diameter which is a size larger than the cylindrical portion at the tip of the cap 160 of the toner cartridge 16 shown in FIG. 3. The holder guide 35 has a supply hole 35*a* which is formed so as to face the discharging hole 161 of the cap 160. The central portion of the bottom of the holder guide 35 protrudes in the form of a boss, in which a D-shaped hole 35*d* is formed. The disk 36 has a shaft 36*d* having a D-shaped cross section, which passes through the D-shaped hole 35*b* of the holder guide 35, and holes or recessed portions 36*b* formed in the disk 36 on a line defining a diameter thereof at positions which are symmetrical with respect to the longitudinal central axis of the flat surface of the shaft 36*a*. Furthermore, reference number 35*c* denotes a flange portion for causing the holder guide 35 to engage the holder 21, and reference number 35*d* shown in FIG. 6 denotes an engaging protrusion engaging the cover 165 of the cap 160 to open the discharging hole 161.

The recessed portion 36*b* has a shape and size so as to engage the protruding portion 163 protruding from the tip end surface of the cap 160 of the toner cartridge 16. When the protruding portion 163 and the shaft 36*a* engage the recessed portion 36*b* and the D-shaped hole 35*b*, respectively, the toner cartridge 16 and the holder guide 35 are integrally rotated while at least the rotational shift therebetween is inhibited. In addition, the gear set 31 has a protrusion 31*a* engaging a hole which is formed by the cut-out 21*c* formed in the partition wall 21*a* of the holder 21, and the cut-out (not shown) of the holder guide 22 facing the cut-out 21*c*, and a D-shaped hole 31*b* having a shape corresponding to the D-shaped hole 35*b* of the holder guide 35. The tip portion of the shaft 36*a* of the disk 36 passes through the D-shaped holes 35*b* and 31*b* to engage the spring 32 while playing therewith, so that the shaft 36*a* rotatably engages a shaft receiving portion 23*a* formed in the inner wall of the chamber 23. The shaft receiving portion 23*a* is shown in the sectional view of FIG. 6 although it is not shown in the exploded perspective view of FIG. 4.

The respective parts with the above described constructions are previously assembled except for the toner cartridge 16. The drive unit 20 is assembled to be mounted on the one end side 17*a* of the cartridge receiving portion 17, and the inlet holder 18 having the biasing lever 19 is mounted on the other end portion 17*b*. The drive mechanism 25 of the drive unit 20 is mounted on the inside and outside of the chamber 23 separated by the partition wall 21*a* of the holder 21, to constitute the gear systems 30 and 31. The holder guide 35 is provided between the partition wall 21*a* of the holder 21 and the engaging partition wall 21*b* engaging the flange portion 35*c* of the holder guide 35 while the disk 36 of the holder guide 35 is mounted. While all of the parts are combined with the holder 21, the holder 21 is covered with the holder cover 22 to be fixed by the shown screw to be assembled, and thereafter, the assembly is fixed to the one end side 17*a* of the cartridge receiving portion 17.

If the peripheral wall of the cylindrical container 60 is nearly housed in the inlet holder 18 when the cylindrical container 60 is inserted from the other end portion 17*b* of the receiving portion 17, there is a problem in that it is difficult to insert and extract the cylindrical container 60. Therefore, the bottom 60A of the cylindrical container 60 is provided with a handle 67 so that the user is easy to hold the cylindrical container 60. In this first preferred embodiment, the handle 65 is formed with a mark (arrow in the figure) 67*a* for showing the direction of the toner discharging hole 161 of the cap 160. In addition, a concavoconvex non-slip portion 67*b* is formed on the surface of the handle 67.

Referring to FIGS. 5 through 7C, the operations for attaching and detaching the toner cartridge 16 on and from the toner supply device with the above described construction will be described. First, in order to attach the toner cartridge 16 on the drive unit 20, after the toner cartridge 16 is horizontally arranged to be sufficiently shaken, the toner cartridge 16 is inserted into the guide hole 18A of the inlet holder 60 from the side of the cap 160 as shown in FIG. 5. At this time, if this insertion is carried out while the user grips the handle 67 of the bottom 60A of the cylindrical container 60 to turn the arrow mark 67*a* upwards, the protruding positioning portion 63 of the cylindrical container 60 is coincident with the recessed portion 18C of the inlet holder 18. By thus inserting the toner cartridge 16, the discharging hole 161 of the cap 160 is inserted while remaining facing upwards. However, since the discharging hole 161 of the cap 160 is closed by the ring-shaped cover 165 at this time, the cover 165 can also prevent the toner from leaking.

Figure 6:
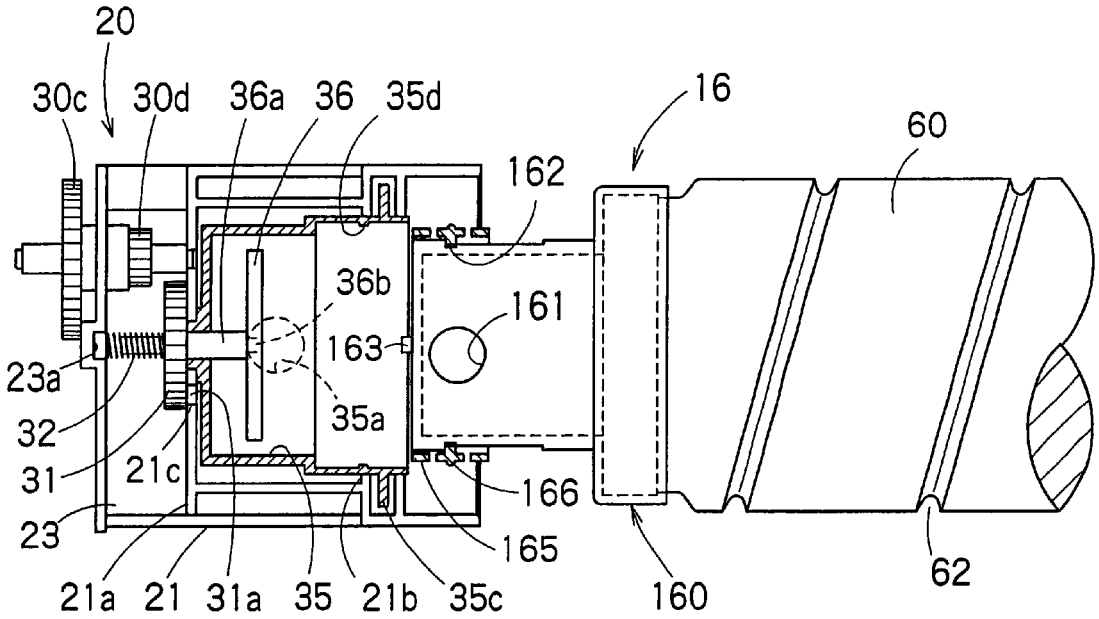
FIG. 6 is a sectional view showing a toner cartridge immediately before being attached.

FIG. 6 is a plan view showing the state that the tip portion of the toner cartridge 16 engages the drive unit 20, which is viewed from the top of FIG. 5 to show the holder 21 and the toner cartridge 16 while the holder cover 22 is removed. This figure shows a cross section of only the holder guide 35 and the cover 165 of the cap 160. If the cartridge 16 is further inserted from the position shown in FIG. 6, the protruding portion 163 serving as the positioning portion engages the recessed portion 36*b* of the disk 36 to cause the tip end surface of the cap 160 to push the disk 36.

Slightly before this, the engaging protrusion 35*d* formed on the inner peripheral surface of the holder guide 35 engages the outer stopper 166*b* of the elastic tongue piece of the cover 165. Thus, the cover 165 slides while the protrusion 167 is guided by the guide groove 164 shown in FIG. 3, so that the discharging hole 161 is open. Thus, the discharging hole 161 is open in the holder guide 35, and the discharging hole 161 is coincident with the supply hole 35*a* of the holder guide immediately after the discharging hole 161 is open. In this state, the protrusion 31*a* of the gear set 31 engages the hole formed by the cut-out 21*c* of the holder 21 and the cut-out of the holder cover 22 facing the cut-out 21*c*. In FIG. 6, the cover 165 moves to the right with respect to the cap 160, so that the inner stopper 166*a* abuts on the engaging portion 162*b*. If the cartridge 16 is further thrust, the upper stopper 166*b* moves to the left in the figure to pass over the engaging protrusion 35*d* to a position shown in FIG. 7A.

Figure 7A:
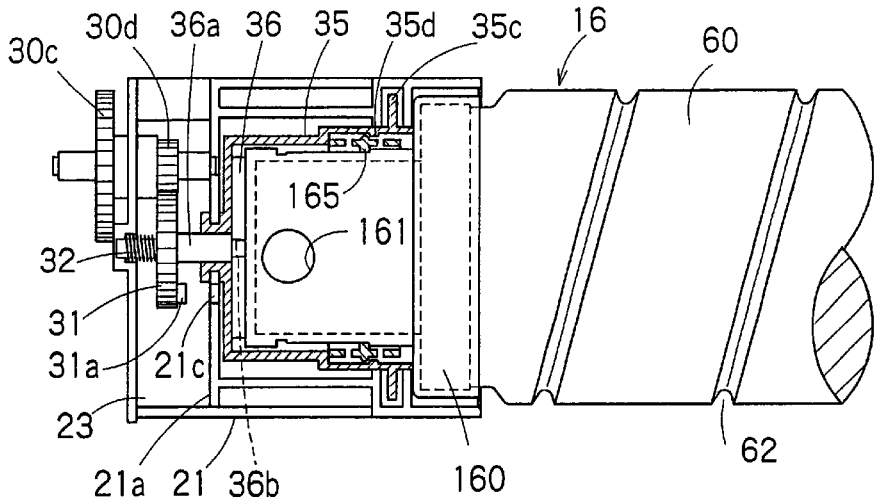
FIGS. 7A through 7C are sectional views showing the operation of detaching a toner cartridge.

Referring to FIG. 6 again, when the toner cartridge 16 is further thrust as described above, while the tip end surface of the cap 160 presses the disk 36 while the cylindrical portion 163 engages the recessed portion 36*b*, the shaft portion 36*a* contacts the shaft receiving portion 23*a* against the spring force of the spring 32 to be positioned. In this state, the gear set 31 mounted on the shaft portion 36*a* meshes with the fourth gear 30*d* of the gear set 30. This state is shown in FIG. 7A. By driving the motor 26 in this state, the torque of the motor is transmitted by the drive mechanism 26 comprising the gear sets 30 and 31 to rotate the cap 160 and the cylindrical container 60.

Figure 7B:
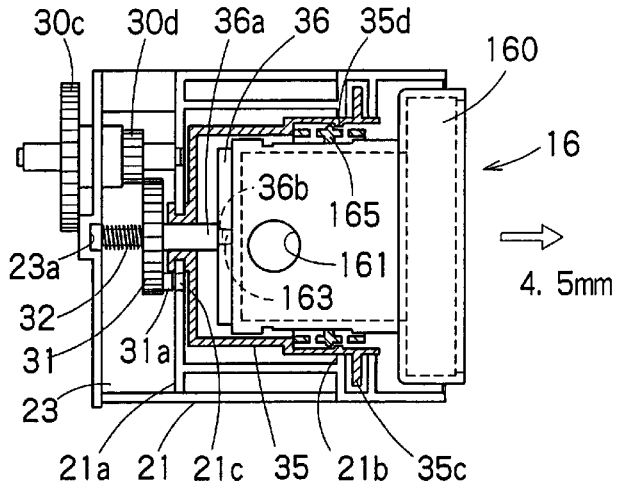
Figure 7C:
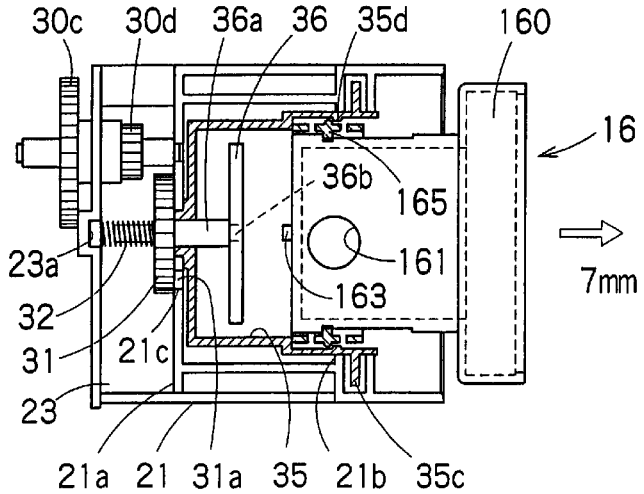

Referring to FIGS. 7A through 7C, the operation of detaching the toner cartridge by the drive unit 20 will be described below. In the conventional toner supply device, it is required to stop the rotation of the toner cartridge at a position, at which the discharging hole and the supply hole face upwards, so as to prevent the toner from leaking from the discharging hole of the cap and the supply hole of the holder guide. However, in the first preferred embodiment of a toner supply device according to the present invention, the rotation of the toner cartridge 16 can be stopped even if the discharging hole 161 is arranged at any rotational positions.

That is, although the toner cartridge 16 can be stopped even if the supply hole 35*a* of the holder guide 35 and the discharging hole 161 of the cap 160 are arranged at any positions, if the toner cartridge 16 is intended to be detached in this state, the toner cartridge 16 can not be detached since the recessed portion 18C of the inlet holder provided at the other end portion of the toner cartridge 16 is not coincident with the protruding positioning portion 63 of the container 60.

When the toner cartridge 16 is detached, the biasing lever 19 mounted on the inlet guide 18 is first open. At this time, the toner cartridge 16, the holder guide 35, the disk 36 and the gear set 31 are moved by the spring 32 by 4.5 mm in the direction shown by the arrow. By this movement by 4.5 mm, the gear 30D is disengaged from the gear set 31, so that the toner cartridge 16 can freely rotate.

Then, by freely rotating the toner cartridge 16 to cause the recessed portion 18C of the inlet guide 18 to be coincident with the protruding positioning portion 63 of the container 60, the toner cartridge 16 can be detached. At this time, since the toner cartridge 16 meshing with the disk 36 is rotated so that the protrusion 31*a* of the gear set 31 is coincident with the position of the engaging hole which is formed by the cut-out 21*c* of the partition wall 21*a* of the holder 21 and the cut-out of the holder cover 22 facing the cut-out 21*c*, the toner cartridge 16, the holder guide 35 and the gear set 31 are further moved by the spring 32 by 2.5 mm in the direction shown by the arrow (therefore, the total quantity of movement is 7 mm).

Thus, even if the toner cartridge 16 is detached, the holder guide 35 is fixed at the lower position so that the supply hole 35*a* faces upwards. Therefore, when a new toner cartridge 16 is inserted, the discharging hole 161 is always coincident with the supply hole 35*a* since the holder guide 35 is positioned.

In addition, when the drive mechanism is operated while the toner cartridge 16 is detached, the gear set 31 is disengaged from the gear 30*d*, so that the holder guide 35 does not rotate. Therefore, the supply hole 35*a* is not shifted, and the gears are not damaged.

Thus, when the toner cartridge 16 is attached and detached without providing the holder guide 35 with any detection mechanisms, the holder guide 35 can be always fixed at a predetermined position. Thus, even if the toner cartridge 16 is detached at any positions, when the toner cartridge 16 is attached again, if the toner cartridge 16 is attached while the protruding positioning portion 63 of the toner cartridge 16 is coincident with the recessed portion 18C of the inlet holder 18, the toner cartridge can be driven while the discharging hole 161 is coincident with the supply hole 35*a*.

In this state, the discharging hole 161 of the toner cartridge 16 is gradually being closed by the cover 165 shown by the two-dot chain line in FIG. 7B. If this is further extracted, the discharging hole 161 is completely closed as shown in FIG. 7C, so that the discharging hole 161 can remain being closed when the toner cartridge 161 is extracted. In this state, if the disk 36 is further moved by 2.5 mm by the biasing force of the spring 32, the toner cartridge 16 is moved by "4.5+2.5=7 mm" toward the inlet holder 18 as shown in FIG. 7C. In this state, since the bottom portion of the toner cartridge 16 is protruded by at least 7 mm from the inlet holder 18, if the user holds and extracts the bottom portion of the cylindrical container 60 of the toner cartridge 16, the used toner cartridge 16 can be extracted.

Figure 8A:
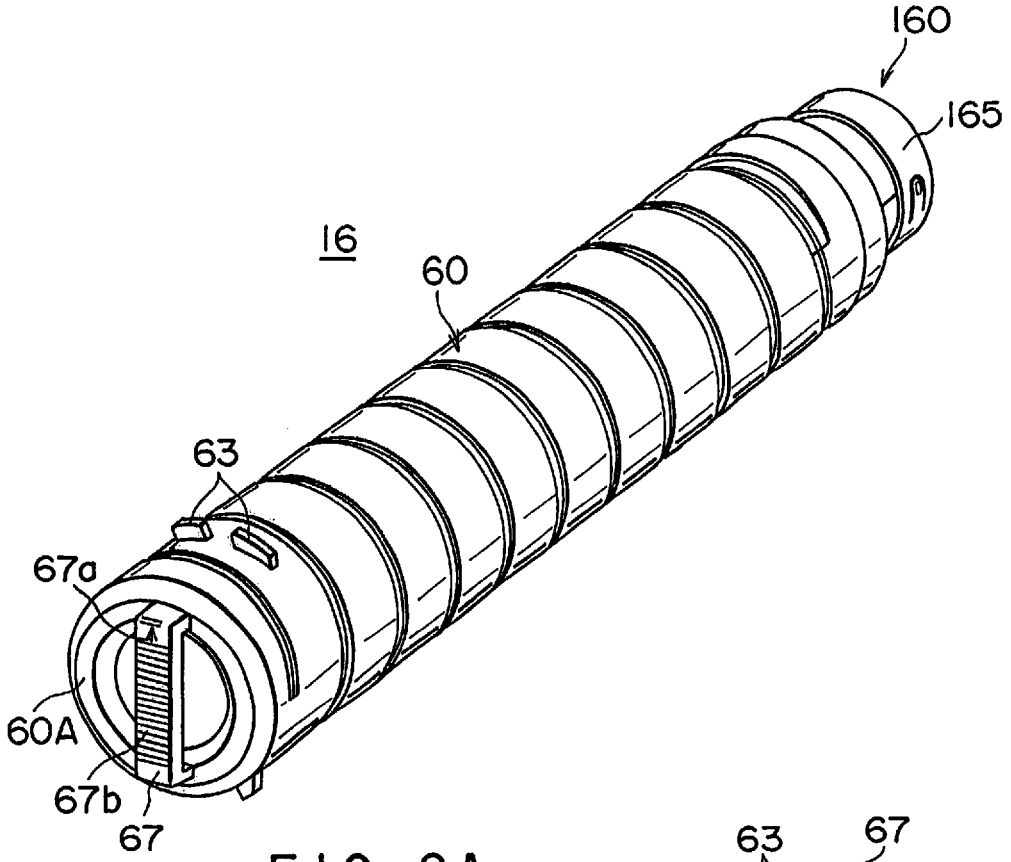
FIGS. 8A and 8B are perspective views of a toner cartridge of the preferred embodiment of a toner supply device according to the present invention, which are viewed from the bottom side and the tip side, respectively.
Figure 8B:
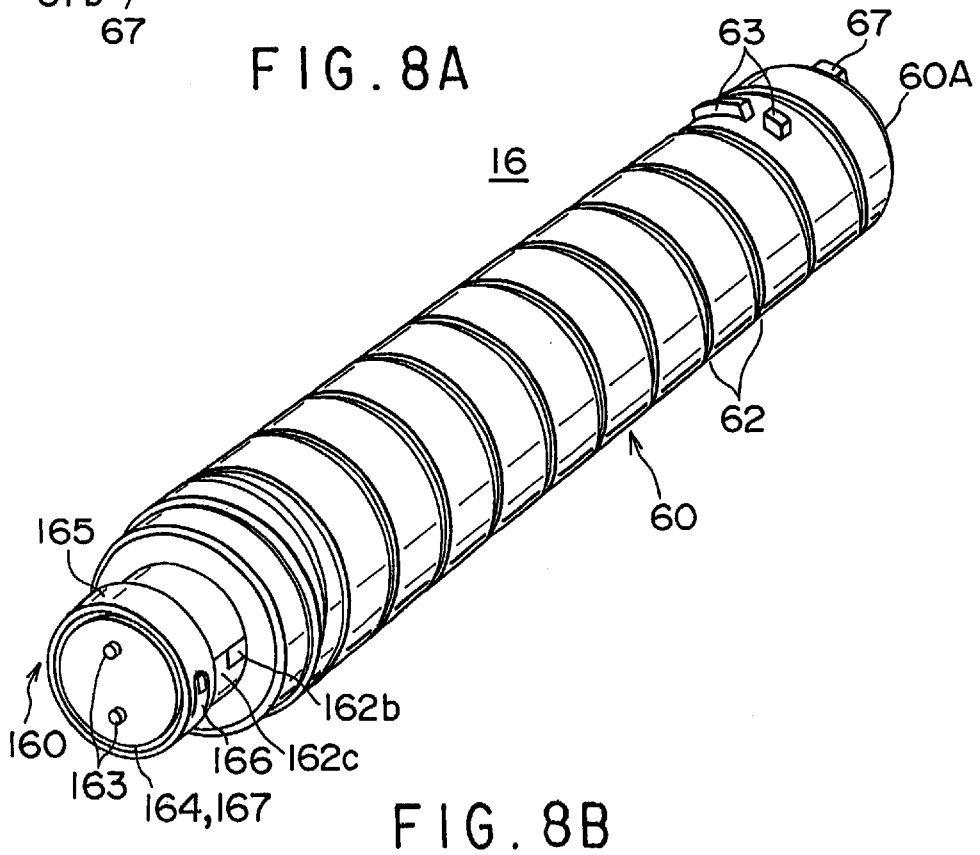
Figure 9A:
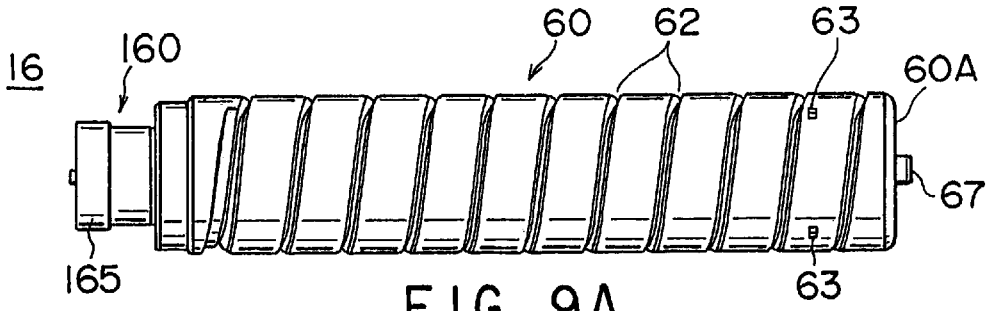
FIGS. 9A through 9D are plan, right side, bottom and left side views of the preferred embodiment of a toner supply device according to the present invention.
Figure 9B:
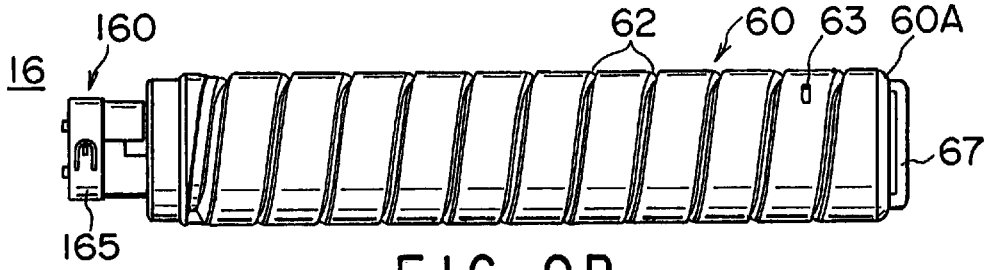
Figure 9C:
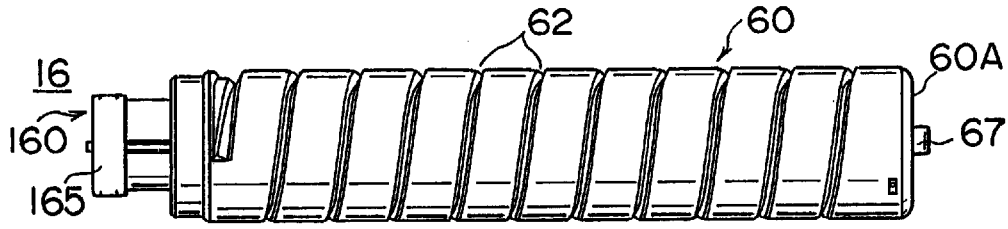
Figure 9D:
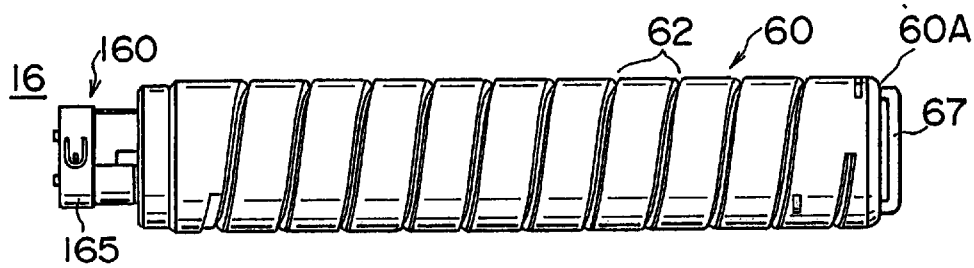
Figure 9E:
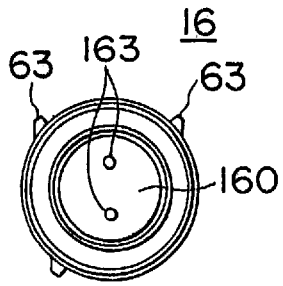
FIGS. 9E and 9F are front and back views thereof which are viewed from the tip and bottom sides, respectively.
Figure 9F:
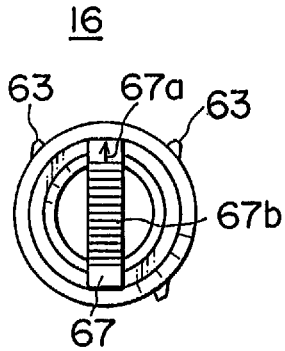

FIG. 8A shows the detailed shape of the handle 67 in the first preferred embodiment wherein the bottom 60A of the toner cartridge is provided as the characteristic construction of the present invention. FIG. 8A is a perspective view of the toner cartridge 16 viewed from the bottom thereof, and FIG. 8B is a perspective view of the toner cartridge 16 viewed from the tip thereof. FIGS. 9A through 9F are six views including plan, right side, bottom, left side, front and back views of the toner cartridge 16 in the first preferred embodiment. As can be clearly seen from the respective figures, the handle 67 is provided on the bottom 67A of the cylindrical container 60. In the toner cartridge in the first preferred embodiment, the handle 67 has a substantially C-shaped cross section so as to be associated with the depth of the recessed portion of the bottom 60A of the cylindrical container 60 for forming a gap which allows the user's hand to enter.

Figure 10:
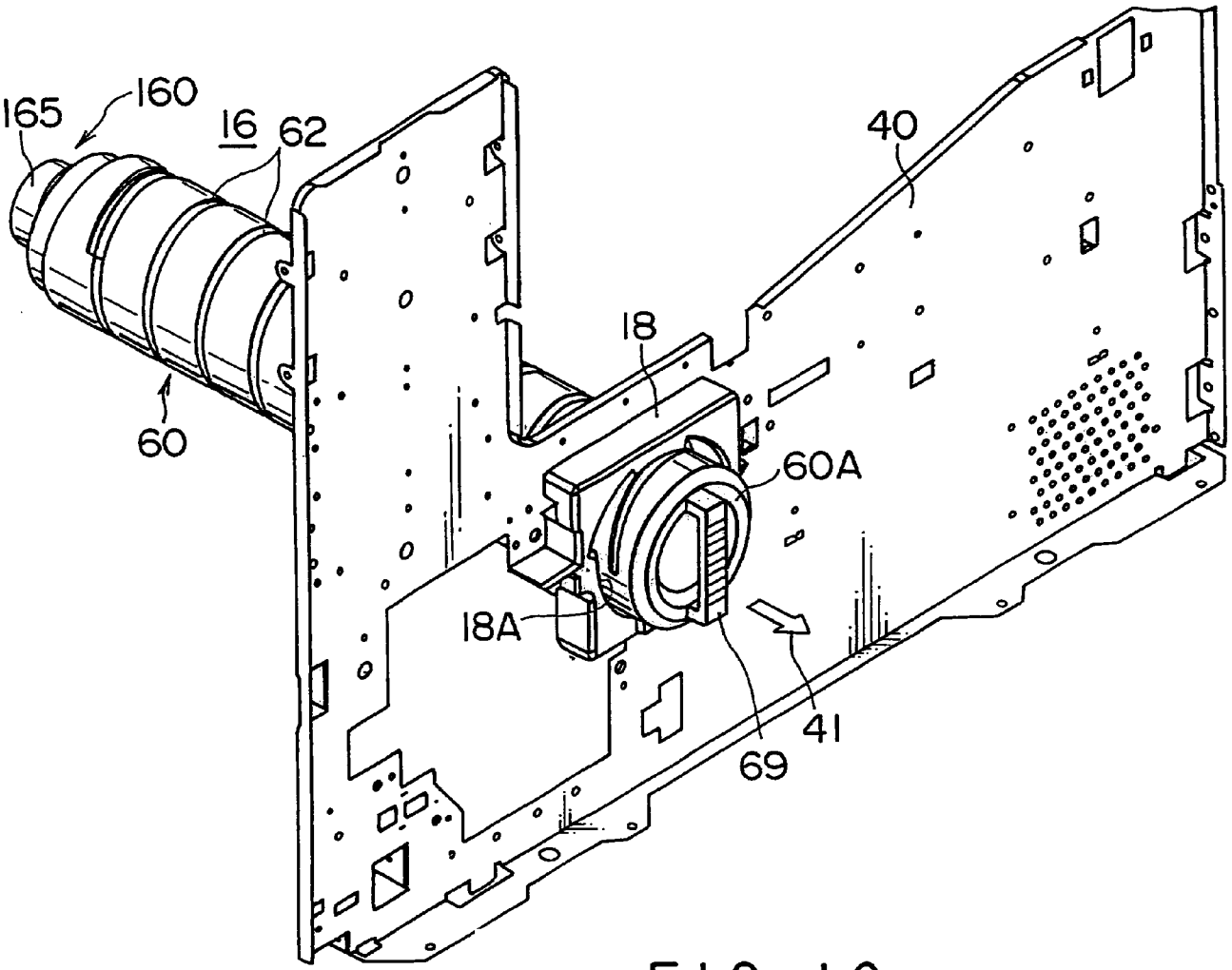
FIG. 10 is a perspective view showing the operation of ejecting the first preferred embodiment of a toner cartridge according to the present invention from a copying machine body.
Figure 11:
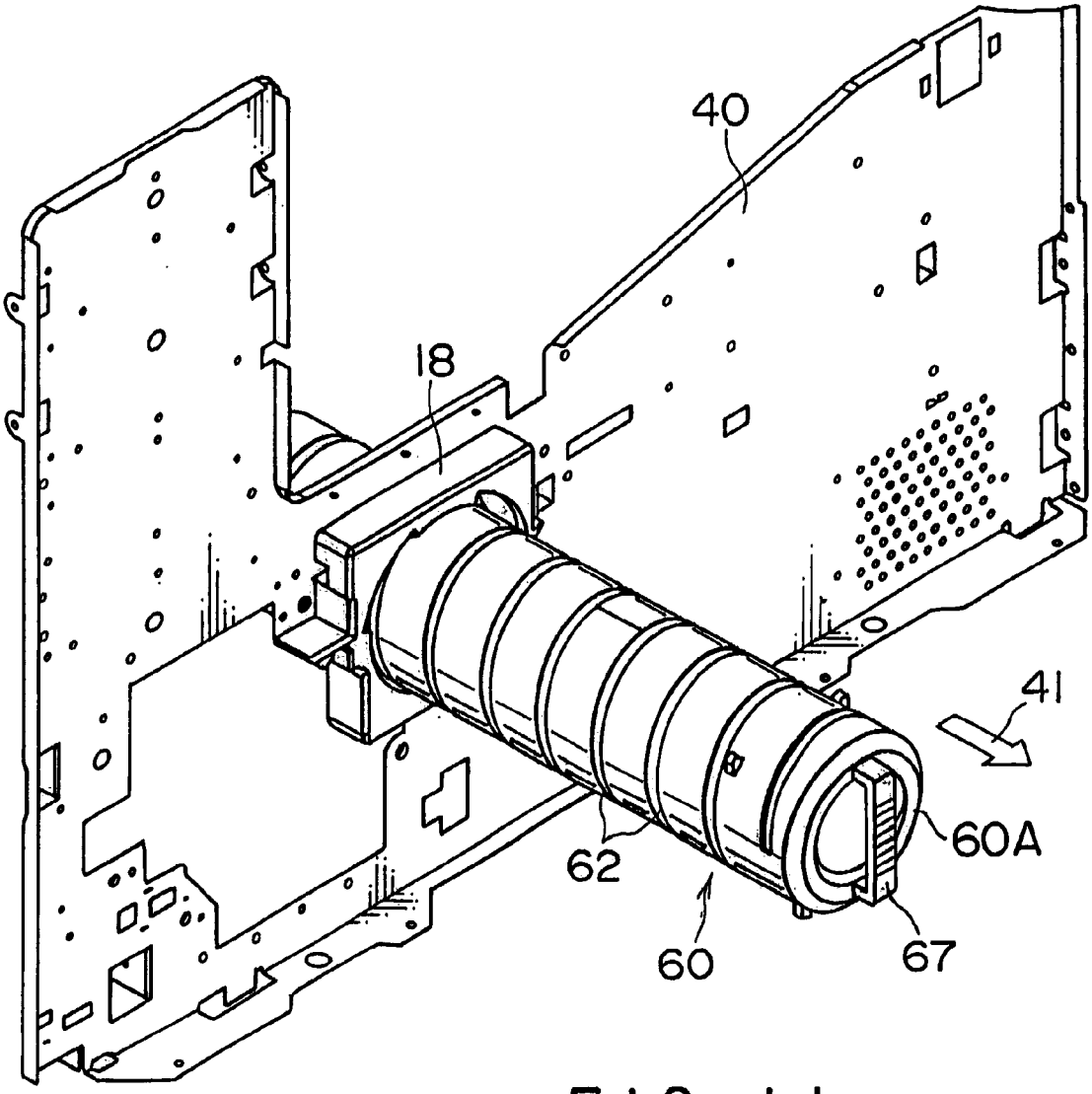
FIG. 11 is a perspective view showing the first preferred embodiment of a toner cartridge according to the present invention while being ejected from the body.
Figure 12:
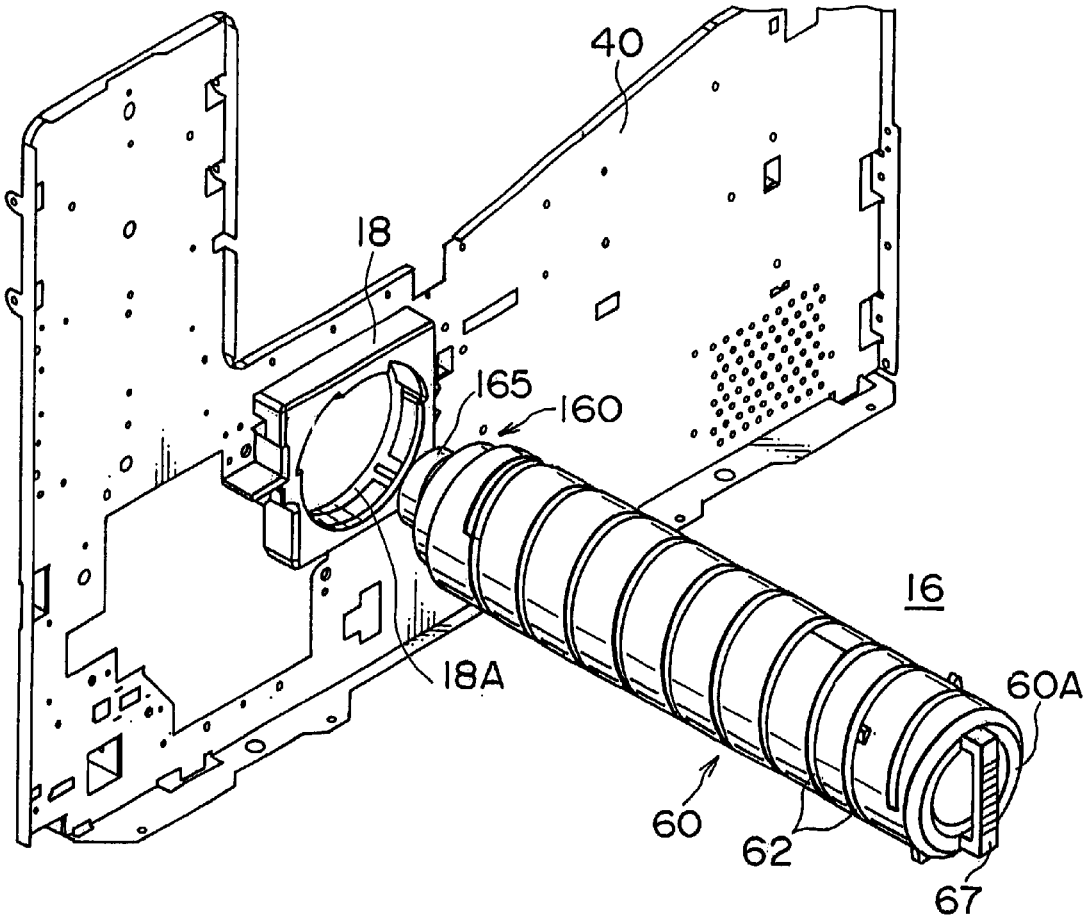
FIG. 12 is a perspective view showing the first preferred embodiment of a toner cartridge according to the present invention after being ejected from the body.

Referring to FIGS. 10 through 12, the operation of detaching the toner cartridge with the above described construction from the copying machine will be described below. The toner cartridge 16 housed in the guide hole 18A of the inlet holder 18 provided on a cabinet panel 40 of the copying machine is usually biased toward the tip by the biasing lever 19 and biasing spring 19A (omitted from the figure). For the engagement of the biasing lever 19, the non-slip portion 67*b* of the handle 67 is used.

By gripping and extracting the handle 67 in the state shown in FIG. 10, the engagement of the holder guide 35 and the cap 160 is released at the tip portion of the toner cartridge 16 to allow the extraction of the toner cartridge 16. After this extractable state, by gripping and extracting the handle 67 as shown by the outline arrow 41, the cylindrical container 60 is gradually extracted as shown in FIGS. 11 and 12.

When the toner cartridge 16 is attached, the reverse operation of the above described operation is carried out. When the toner cartridge is attached, the toner is substantially fully filled in the container. Therefore, the user can more easily carry out operation than when nothing is provided on the bottom 60A, since the handle 67 is provided on the bottom 60A of the toner bottle according to the present invention. Thus, it is possible to provide a toner cartridge which can be rapidly and easily exchanged and which has greatly improved workability during exchange, and a toner supply device using this toner cartridge.

Figure 13:
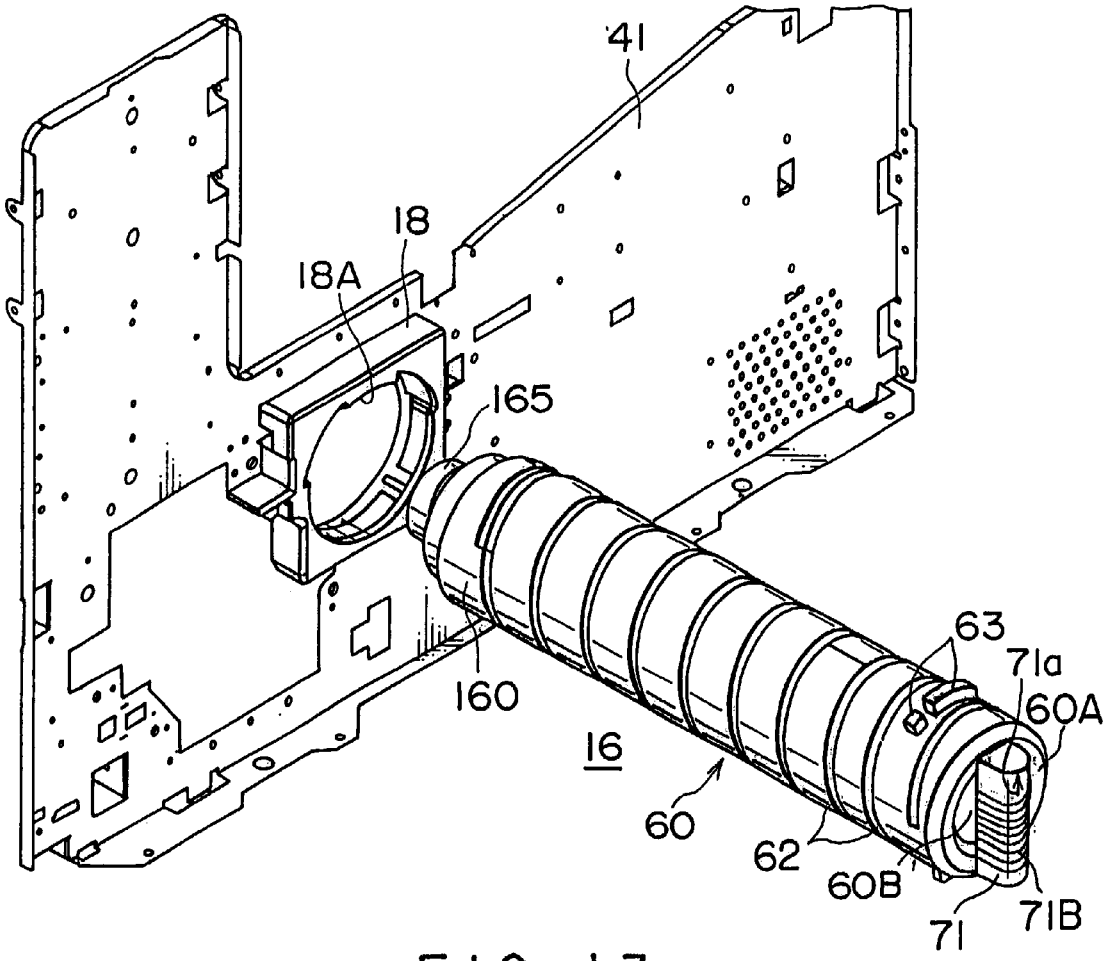
FIG. 13 is a perspective view of the second preferred embodiment of a toner cartridge according to the present invention.

Furthermore, while the shape of the handle 67 has had the C-shaped cross section in the above described first preferred embodiment, the present invention should not be limited thereto. For example, as the second preferred embodiment of a toner cartridge according to the present invention shown in FIG. 13, if a recessed portion 60B lowered by one step from the bottom of a cylindrical container 60 is utilized, a rod-like handle 71 may be provided. In such a toner cartridge 60 in the second preferred embodiment, the handle 71 has an arrow 71*a* for indicating a position, at which a toner discharging hole of a cap 165 of the cylindrical container 60 is provided, and a non-slip portion 71*b* having a concavoconvex surface. Other constructions and operations are the same as those of the toner cartridge and toner supply device in the first preferred embodiment, so that the duplicated descriptions are omitted.

Figure 14:
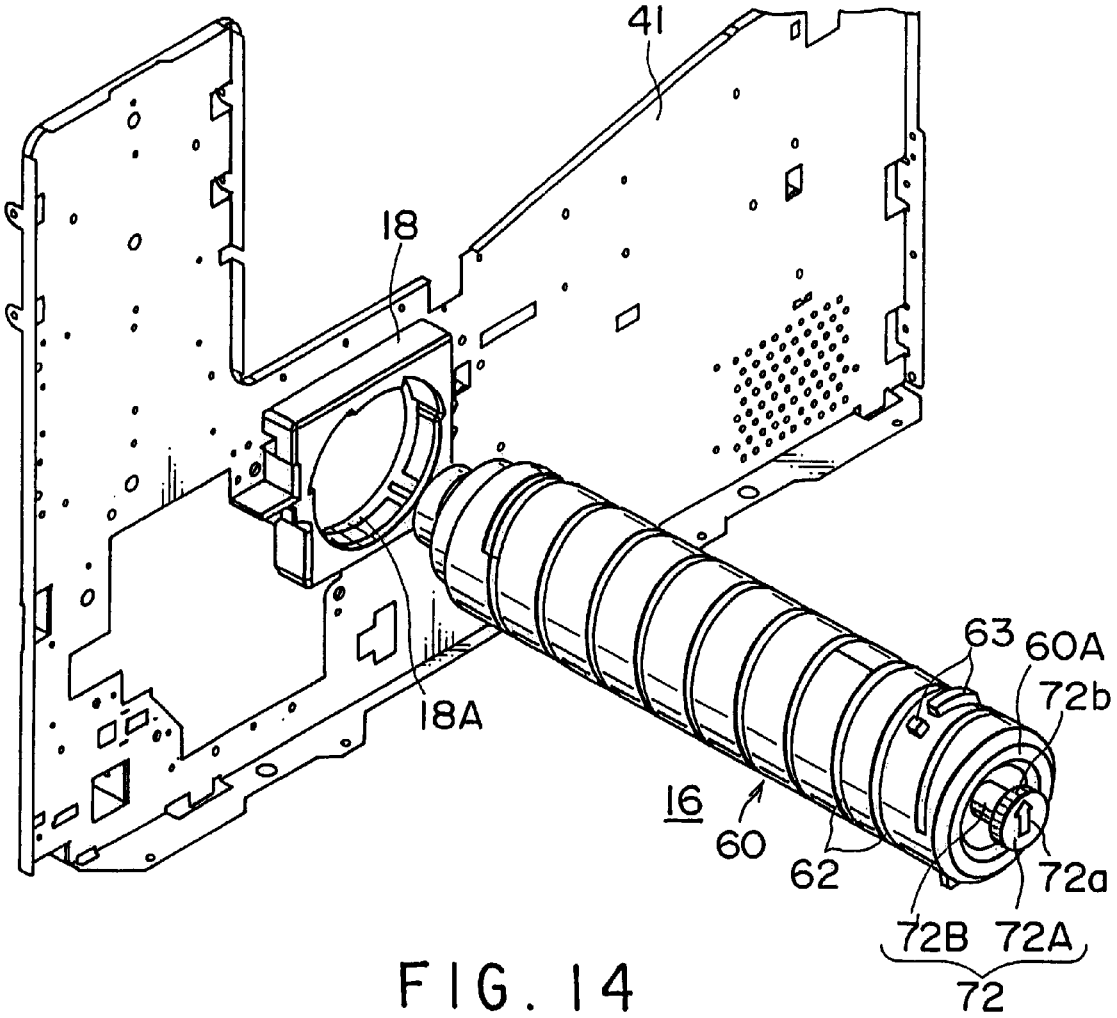
FIG. 14 is a perspective view of the third preferred embodiment of a toner cartridge according to the present invention.

While the toner cartridge in the first and second preferred embodiment has had the rod-like handle, the present invention should not be limited thereto. As the third preferred embodiment of a toner cartridge according the present invention shown in FIG. 14, the toner cartridge may have a circular handle 72. In FIG. 14, the handle 72 comprises a circular gripped portion 72A and a supporting rod 72B. On the surface of the gripped portion 72A, an arrow 72*a* for turning a toner discharging hole upwards is formed. On the outer peripheral side of the gripped portion 72A, a knurled or concavoconvex non-slip portion 72*b* is provided. Other constructions and operations are the same as those of the toner cartridge and toner supply device in the first and second preferred embodiments, so that duplicated descriptions are omitted.

Figure 15:
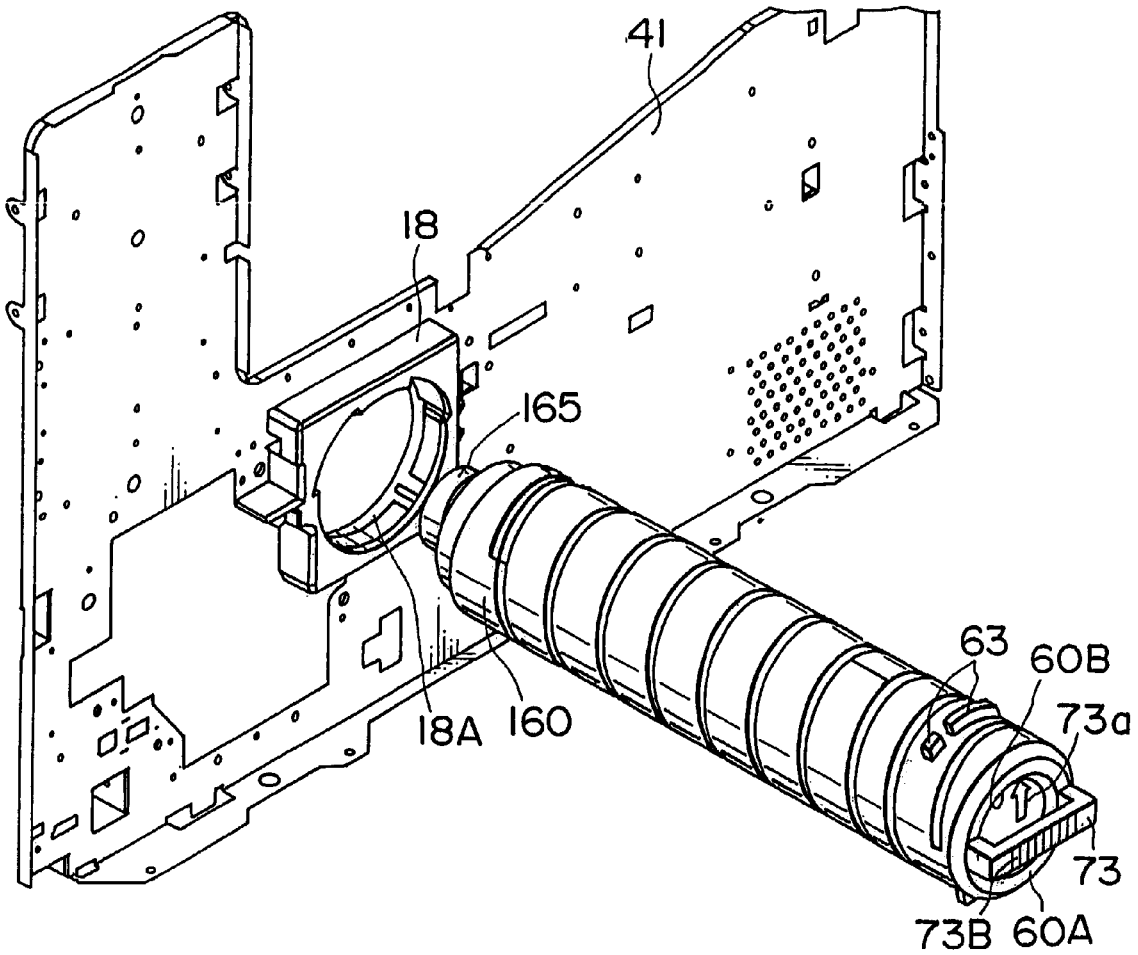
FIG. 15 is a perspective view of the fourth preferred embodiment of a toner cartridge according to the present invention.
Figure 16:
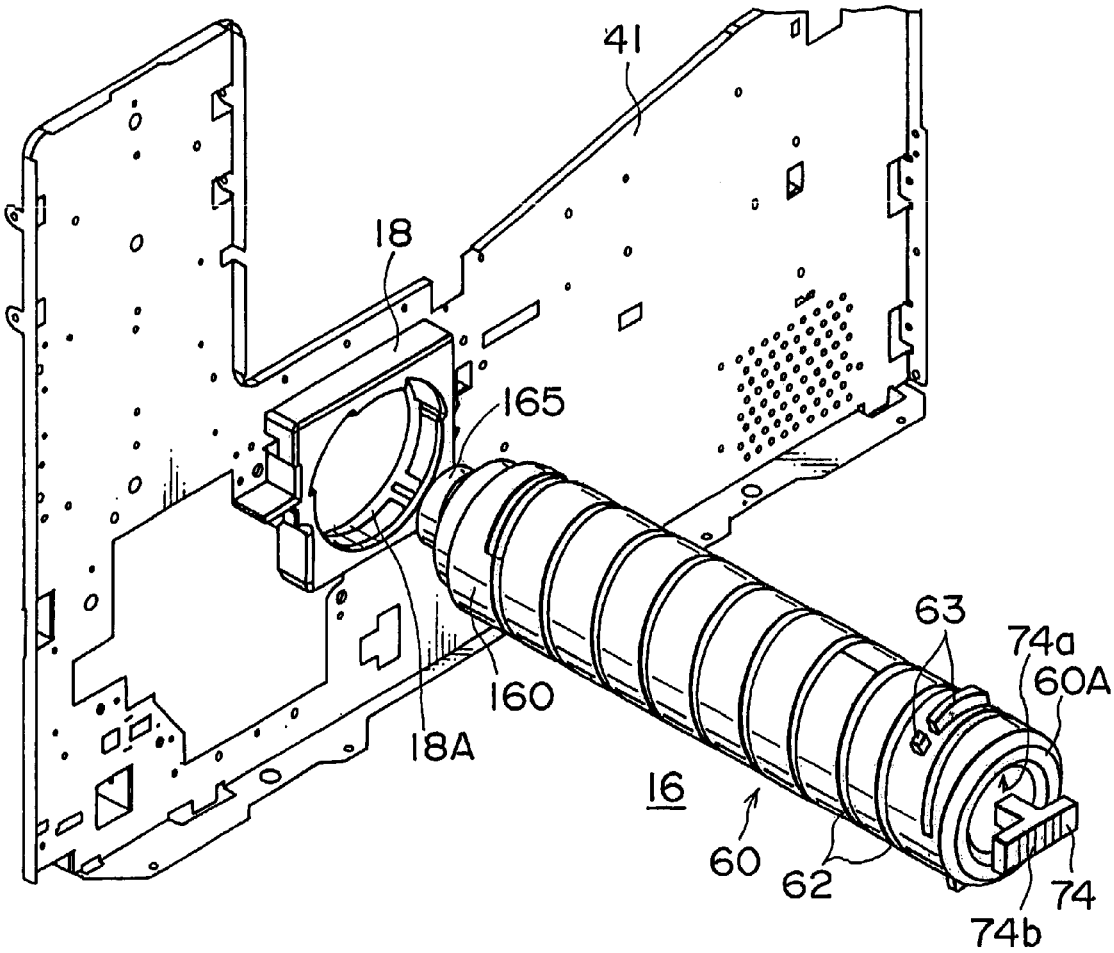
FIG. 16 is a perspective view of the fifth preferred embodiment of a toner cartridge according to the present invention.

Furthermore, the arrow has been provided on the surface of the gripped portion in the above described preferred embodiments, the present invention should not be limited thereto. As the fourth preferred embodiment of a toner cartridge according to the present invention shown in FIG. 15, an arrow 73*a* may be provided on a recessed portion 60B formed in a bottom 60A of a cylindrical container 60. In addition, in the toner cartridge in the fourth preferred embodiment, a handle 73 may be formed so as to extend in a direction perpendicular to a diameter defining line including a toner discharging hole, unlike the first and second preferred embodiments wherein the handle is formed so as to extend in a direction along the diameter defining line including the toner discharging hole.

Similarly, as the fifth preferred embodiment of a toner cartridge according to the present invention, a handle 74 having a substantially T-shaped cross section may have a gripped portion which extends in a direction perpendicular to a diameter defining line including a toner discharging hole and which is supported on a recessed portion 60B of a bottom 60A of a cylindrical container 60 by means of one leg portion without being supported on the bottom 60A by means of leg portions on both sides of the handle. In the toner cartridge in the fifth preferred embodiment, an arrow 74*a* may be formed on a recessed portion 60B of the bottom 60A. In addition, a concavoconvex non-slip portion 74*b* is formed on the surface of the gripped portion.

What is claimed is:

1. A toner supply device comprising:

a toner cartridge including a spiral protruding portion spirally protruding from at least an inner peripheral surface thereof, a filling positioning portion provided in a peripheral surface thereof in the vicinity of a base end portion of closed both end portions, and a toner discharging hole formed in the periphery thereof in the vicinity of a tip end portion of the both end portions, said toner cartridge having a handle for holding said toner cartridge on a bottom thereof, said toner cartridge having a cylindrical container, on which a mark for indicating the direction of said toner discharging hole is formed at a position, at which the mark is capable of being visually observed from a bottom side;

a cartridge supporting portion, provided on a body, for horizontally supporting thereon said toner cartridge while allowing rotation of said toner cartridge;

an inlet holder provided on one end of an inlet side of said cartridge supporting portion, said inlet holder including a body-side positioning portion, which engages said filling positioning portion so that said toner discharging hole always faces upwards when said toner cartridge is attached and detached, and a biasing member for continuing to bias said base end portion of said toner cartridge toward said tip end portion by a predetermined biasing force after said toner cartridge is attached; and a drive unit including a cup-shaped gripping portion for covering a peripheral surface of said one end including said toner discharging hole of said toner cartridge and for gripping said toner cartridge while a position of a toner supply hole corresponding to said toner discharging hole of said toner cartridge is coincident with said toner discharging hole so as to always face upwards when said toner cartridge is attached, a drive gear comprising a gear set including a gear provided on a bottom of said gripping portion and a gear meshing therewith, and rotation driving means for applying a torque to said gripping portion and said toner cartridge gripped by said gripping portion via said drive gear.

2. A toner supply device as set forth in claim 1, wherein said toner cartridge comprises: said cylindrical container, which has said spiral protruding portion and said filling positioning portion and the diameter of which decreases via a stepped portion so as to form a small-diameter portion at a tip end thereof, said small-diameter portion having an end surface being open; and a cap which is mounted on a tip end portion of said cylindrical container to engage said small-diameter portion and which has said toner discharging hole in a peripheral surface thereof so that the relationship between the position of said filling positioning portion and the position of said toner discharging hole is constant.

3. A toner supply device as set forth in claim 2, wherein said toner cartridge further comprises a cover member for shielding said toner discharging hole, said cover member being formed of a ring having a greater width than a diameter of said toner discharging hole formed in the peripheral surface of said cap, sand cover member being mounted so that said small-diameter portion of said cap is slidable in axial directions.

4. A toner supply device as set forth in claim 3, wherein a seal of an elastic member for enhancing a face contact with said cover member is applied on the periphery of said small-diameter portion of said cap at least at a position, at which said toner discharging hole is formed.

5. A toner supply device as set forth in claim 3, wherein a groove extending in axial directions is formed in an outer peripheral surface of said small-diameter portion of said cap, and a protrusion extending in axial directions is formed in an inner peripheral surface of said cover member, said groove engaging said protrusion to inhibit rotation said cover member to allow only slide of said cover member.

6. A toner supply device as set forth in claim 2, wherein a positioning protruding portion for regulating rotational movement of said toner cartridge is provided on a tip end surface of said cap.

7. A toner supply device as set forth in claim 2, wherein said filling positioning portion formed on said base end side peripheral surface of said cylindrical container is formed of a protrusion protruding in a radial direction of a circular container.

8. A toner supply device as set forth in claim 1, wherein said handle formed on a bottom of said toner cartridge is supported on two legs having a substantially C-shaped cross section, said handle being associated with a recessed portion formed in said bottom to form a sufficient gripping margin.

9. A toner supply device as set forth in claim 8, wherein a mark for indicating the position of said toner discharging hole is formed in the surface of said handle.

10. A toner supply device as set forth in claim 8, wherein said handle has a non-slip portion.

11. A toner supply device as set forth in claim 1, wherein said handle formed on a bottom of said toner cartridge is supported on one leg having a substantially T-shaped cross section, said handle being associated with a recessed portion formed in said bottom to form a sufficient gripping margin.

12. A toner supply device as set forth in claim 11, wherein a mark for indicating the position of said toner discharging hole is formed in the surface of said handle.

13. A toner supply device as set forth in claim 11, wherein said handle has a non-slip portion.

14. A toner cartridge for use in a toner supply device for supplying a toner to an image forming system for forming an optional image including characters and pictures with said toner, said toner cartridge comprising:

a toner container having a cylindrical shape having an opening at a tip end thereof, said toner container carrying a toner, which is housed therein, toward said opening along a spiral protruding portion formed in an inner peripheral surface thereof when being rotated about an axis thereof, said toner container having a handle on an external surface of a base end portion thereof;

a substantially cup-shaped cap engaging said opening and having a toner discharging hole for discharging said toner cartridge in said toner container, said toner discharging hole always facing in a predetermined direction if said toner container is turn in a certain rotational direction with respect to an axis of said toner container by fixing said cap in a predetermined positional relationship when said, toner container is attached; and a cylindrical cover engaging said cap so as to reciprocate in axial directions with respect to said cap, said cylindrical cover being capable of engaging said cap at a first position, at which said toner discharging hole is closed to prevent said toner from being discharged, and at a second position, at which said toner discharging hole is open to allow said toner to be discharged.

15. A toner cartridge as set forth in claim 14, wherein said handle formed on a bottom of said toner cartridge is supported on two legs having a substantially C-shaped cross section, said handle being associated with a recessed portion formed in said bottom to form a sufficient gripping margin.

16. A toner cartridge as set forth in claim 15, wherein a mark for indicating the position of said toner discharging hole is formed in the surface of said handle.

17. A toner cartridge as set forth in claim 15, wherein said handle has a non-slip portion.

18. A toner cartridge as set forth in claim 14, wherein said handle formed on a bottom of said toner cartridge is supported on one leg having a substantially T-shaped cross section, said handle being associated with a recessed portion formed in said bottom to form a sufficient gripping margin.

19. A toner cartridge as set forth in claim 18, wherein a mark for indicating the position of said toner discharging hole is formed in the surface of said handle.

20. A toner cartridge as set forth in claim 18, wherein said handle has a non-slip portion.

21. A toner cartridge as set forth in claim 14, wherein a torque for rotating said toner container, which is integrally connected to said cap, about an axis thereof is applied to said cap from said image forming system.

22. A toner cartridge as set forth in claim 21, wherein said engaging portion comprises at least two protruding portions protruding from a tip end surface of said cap.

23. A toner cartridge as set forth in claim 22, wherein said toner discharging hole is formed in an outer peripheral surface of said cap at a position on a line which is a line drawn between said two protruding portions and which is substantially perpendicular to said axis.

24. A toner cartridge as set forth in claim 14, wherein said cap has protrusions on tip and base end sides along a bus line on an outer peripheral surface, and said cylindrical cover is movable in axial directions between said two protrusions to abut on said protrusions.

25. A toner cartridge as set forth in claim 24, wherein said two protrusions of said cap are formed at positions shifted from said discharging hole of said cap by substantially 90 degrees.

26. A toner cartridge as set forth in claim 24, wherein said cylindrical cover has at least two substantially U-shaped cut-outs formed in a peripheral portion thereof to form tongue pieces serving as cantilevers having disconnection, each of said tongue pieces having external and internal stoppers formed on the surface and reverse surface thereof in the vicinity of a tip end thereof, said internal stopper being slidable between said two protrusions of said cap to abut on said protrusions.

27. A toner cartridge as set forth in claim 14, wherein a groove and a protrusion, which extend in axial directions and which engage with each other, are formed in an outer peripheral surface of said cap and an inner peripheral surface of said cylindrical cover, respectively, said cylindrical cover being attached to and detached from said cap by sliding said groove and said protrusion while said groove engages said protrusion, so that the relationship between the relative rotations of said cap and said cylindrical cover about the axes thereof is regulated to be a predetermined relationship.

28. A toner cartridge as set forth in claim 14, wherein a seal for decreasing a gap between said cylindrical cover and said cap is provided between said cylindrical cover and said cap, said seal having a cut-out which is coincide with said toner discharging hole to inhibit leakage of said toner when said toner discharging hole is closed by said cover.

29. A toner cartridge as set forth in claim 14, wherein a protruding positioning portion is formed on the outer peripheral surface of said toner container at a predetermined position, said toner discharging hole being turned in a predetermined direction by turning said toner container about the axis thereof on the basis of said positioning portion, said toner cartridge being attached and detached in this state.

* * * * *